United States Patent [19]

Cunningham

[11] 4,268,993

[45] May 26, 1981

[54] GRASS SPORTS SURFACES AND A METHOD FOR MAINTAINING THEM

[76] Inventor: Percy C. Cunningham, 3545 Wellington Crescent, N. Vancouver, B.C. V7R 3B3, Canada

[21] Appl. No.: 40,194

[22] Filed: May 18, 1979

[51] Int. Cl.[3] ..... E02B 11/00; A01G 31/00

[52] U.S. Cl. ..... 47/58; 47/1 R; 47/62; 405/37

[58] Field of Search ..... 405/37–38; 47/1 R, 59, 62, 48.5, 2

[56] References Cited

U.S. PATENT DOCUMENTS

| | | | |
|---|---|---|---|
| 1,171,558 | 2/1916 | Taylor | 47/1 R |
| 1,967,803 | 7/1934 | Boland | 47/2 X |
| 2,031,146 | 2/1936 | Dodge | 405/37 X |
| 2,983,076 | 5/1961 | Merrill | 47/62 |
| 3,309,875 | 3/1967 | Niederwemmer | 405/38 |
| 3,408,818 | 11/1968 | Hemphill | 405/37 |
| 3,461,675 | 8/1969 | Izatt | 405/38 |
| 3,578,431 | 5/1971 | Ingestad et al. | 47/62 X |
| 3,820,280 | 6/1974 | Gilgen | 47/1 X |
| 3,908,385 | 9/1975 | Daniel et al. | 405/37 |

FOREIGN PATENT DOCUMENTS

| | | | |
|---|---|---|---|
| 1945067 | 9/1971 | Fed. Rep. of Germany | 47/2 |
| 2405330 | 6/1979 | France | 405/38 |
| 482615 | 7/1953 | Italy | 405/38 |

*Primary Examiner*—Robert E. Bagwill
*Attorney, Agent, or Firm*—Cole, Jensen & Puntigam

[57] ABSTRACT

A level unobstructed grass sports and recreation surface wherein the grass is deeply rooted in a layer of sand overlying a layer of gravel and preferably nurtured from below to provide a controlled growing environment exhibiting vigorous growth. The sand has more positive vertical liquid flow characteristics whereas the gravel has better horizontal liquid flow characteristics and the appropriate gradation selection of both determines the high drainage ability and uniform fertilizer/irrigation distribution throughout the system. The grass surface is defined by a water tight membrane extending from the perimeter, adjacent the surface and completely underlying the gravel layer. Control means are provided to detect the liquid level contained within the membrane and add or remove liquid to maintain the appropriate level. The buried conduit system is used for the controlled addition of water/fertilizer and excess drainage removal. The nutrified liquid from the reservoir is hydroponically supplied to the roots of the grass on a continuous demand basis. Heating cable may be placed at the boundary zone on top of the gravel and sand layers to warm the sand to remove frost and melt snow. An insulation layer may be placed beneath the membrane to minimize frost penetration to the subgrade. The system may be either completely automatic and programmed to accommodate external conditions such as degrees of use of the field, climatic conditions or the like or alternatively may be partially automatic and supported by more standard methods. Coupled with the control system can be a sensing unit to determine automatically the nature of the contained liquid.

28 Claims, 10 Drawing Figures

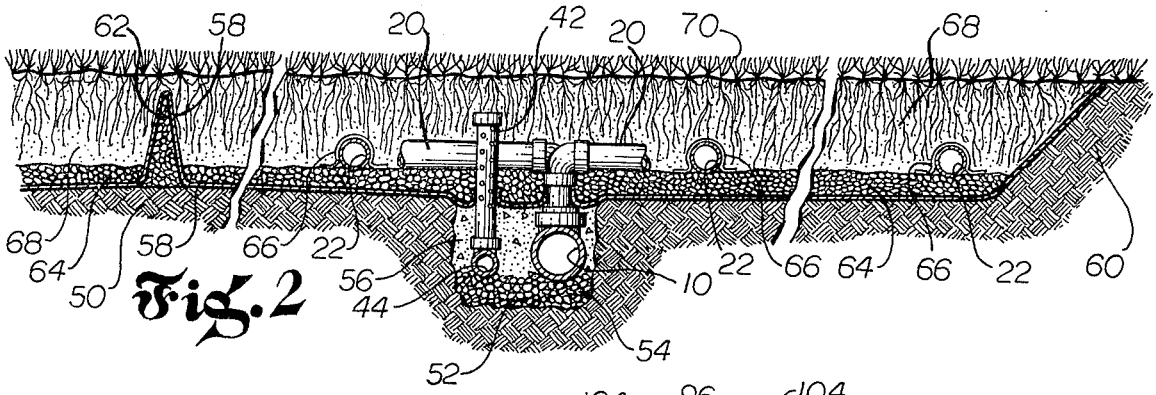
Fig. 2
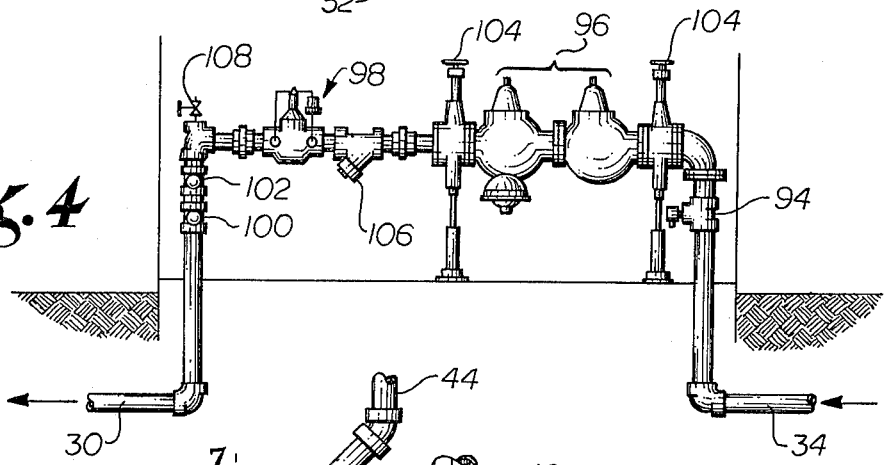
Fig. 4
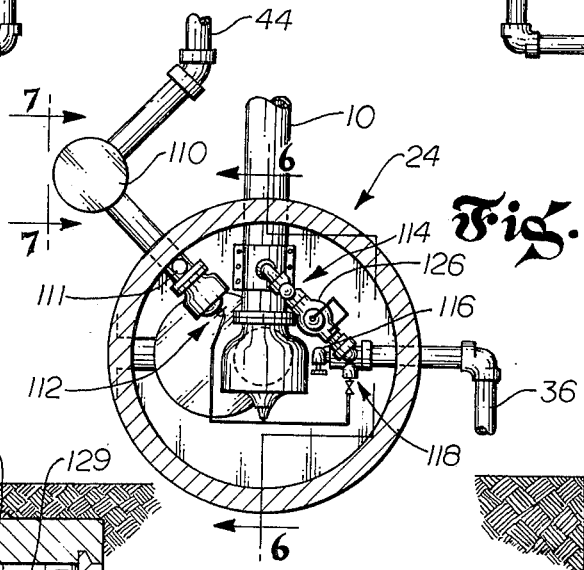
Fig. 5
Fig. 6
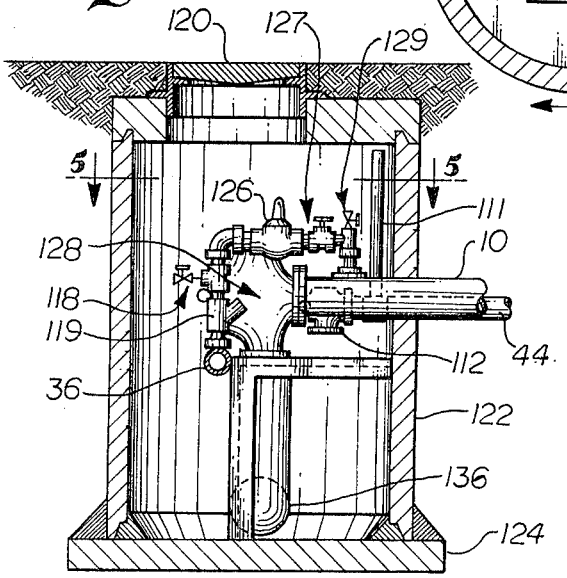
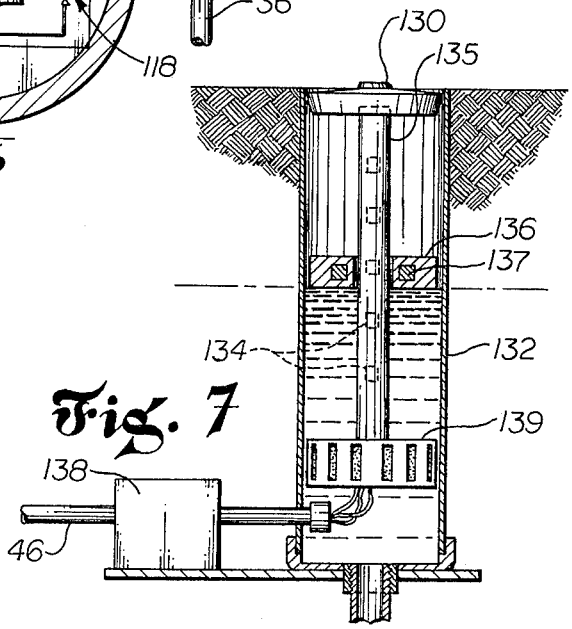
Fig. 7

GRASS SPORTS SURFACES AND A METHOD FOR MAINTAINING THEM

BACKGROUND OF THE INVENTION

As is well known, the construction of a good quality all weather grass playing surface and its maintenance for recreational purposes and active sports, such as soccer and football, has been a problem of long standing.

One of the more recent attempts at resolving this problem has resulted in use of an artificial surface. These surfaces have reduced the regular maintenance required but the cost to repair for wear and tear generally exceeds the cost of maintenance of a natural grass field. Further, the playing conditions immediately over a synthetic surface are far less tolerable than over a grass surface since the synthetic and its supporting surface retain heat. All synthetic surfaces have suffered from the inability to provide adequate drainage. In general, these synthetic surfaces are not completely acceptable to player associations since they have a higher incident of injury than that exerpienced on a good quality natural grass surface.

In general, the factors which must be considered in designing and maintaining a playing surface include the needs of the player utilizing the surface, the requirements of the agrologists in plant growth and maintenance and the correct application of acknowledged engineering principles. The finished product will experience variable and sometimes unpredictable environmental considerations. The total growth and maintenance system must have a flexibility built into it such that the variables may be accommodated.

The selected grass used must be of a type which has good wear ability characteristics, but also must satisfy the climatic conditions in the locality where it is to be used. Once the selection has been made as to the seed mixture, the plant itself must be established and must be capable of vigorous growth to provide for rapid self-repair following user damage. The grass must be well anchored in its growing medium to minimize tear out by the participant and it should provide a uniform surface throughout the applicable season.

It is desirable that the quality of the surface be constant for the entire grassed area and that the surface be able to be used extensively even under adverse climatic conditions. This desire obviously requires the surface be free from an accumulation of water and frost and that the watering and fertilization application do not interrupt use. The ground conditions should be firm and yet provide a cushion normal for a well established turf which experience has shown to minimize player injuries.

It is further desirable that the playing area should be free from obstructions such as sprinklers or the like and reasonably level throughout its entirety.

Maintenance personnel require a minimization of the operational function needed to maintain the surface while retaining a good quality grass condition.

PRIOR ART

In general, grass surfaces heretofore provided can be generally classified as the soil turf field, the modified sand field and the membrane sand field.

The soil-turf playing surface is a classical method wherein the growing medium is a natural good quality soil placed over a granular material. Drainage is provided by providing a crown to the surface and subsurface drains. Irrigation is applied to the surface by conventional methods. Fertilizer is generally applied to the surface through mechanical spreading or through sprinkler applied liquid fertilizer.

These soil-turf fields in general do not stand up to more than minimal use and require heavy maintenance. In wet locations, these fields are consistently muddy due to poor drainage characteristics whereas in dry conditions, the grass shows the affect of the heat and in general are not well nourished. In hot locations, surface applied irrigation experiences large evaporation losses to atmosphere and a build up of water borne impurities at the surface damages the grass. Surface compaction caused by the natural rainfall, surface irrigation and player use generally renders the drainage system ineffective. The compaction also prevents oxygen from reaching the roots and inhibits growth. The surface runoff attempted by crowning the field is not rapid enough even under minimal rainfall. The grass plants are generally surface hugging because of the fact that the water, nutrients and oxygen required are all located there. In this weakened state, the grass may be easily pulled out during normal play, creating bare areas which are not readily self-repairable and require extensive resodding. A weakened grass is more susceptible to disease and infestation problems. This method does not lend itself to soil warming techniques since the melted frost and snow aggravates the lack of drainage and turns the surface to mud. In cold climates, the surface freezes rapidly due to the high silt content and its moisture retaining characteristics.

The inadequacy of the soil turf method has led to development of both the modified sand and the membrane sand methods. In each of these cases, the primary attempt is to overcome the drainage and compaction problem.

The modified sand method uses two classifications of sand as a growing medium, i.e. a bottom layer of natural clear sand while the top surface is a mixture of sand and organics. Drainage is provided by an underlying grid and irrigation and fertilizers are surface supplied by the same means as for soil turf method.

The modified sand method has essentially uncontrolled drainage through the sand layer and therefore the modified surface zone is essential to avoid drought conditions at the level of plant growth. Although the addition of organics retain the nutified moisture and oxygen relation in the surface layer for good plant growth, the organics also retain water, slow down the drainage rate and result in a soft and slippery surface. The grass is surface hugging for the same reasons as the soil turf field. A major problem in this method is lack of long term control. The surface zone, although selected for proper liquid retention characteristics at the time of design, is subject to normal decomposition and leeching of the organics resulting in their loss through the drainage system. Further, the decomposition of the organic material consumes nitrogen necessary for strong healthy growth. The eventual replacement of the organics is impossible without entire replacement of the surface layer, an expense similar to resodding for the soil-turf field. The effectiveness of soil warming techniques to remove snow and frost are inhibited by the lack of the systems ability to continuously replace lost moisture caused by the cold water drying effect. The surface condition results in freezing conditions similar to the soil turf field.

The membrane sand method is the result of efforts to capitalize on the principles of hydroponic growth, which has proven to be totally successful with a controlled propagation of plants in a nursery environment. Although variations exist, in general, the membrane sand method comprises of a natural sand growing medium which is completely isolated by an impervious membrane to provide a contained reservoir of water and isolate the area. Over the membrane and within the isolated area is placed the pipe or conduit system which is tied into a drainage discharge system located outside the field area to allow removal of excess water. Over and around the pipes are placed sand and the regulation of the excess drainage discharge is provided by some form of weir like action or pumps or both.

These systems have not been adequately designed to properly handle sub-surface applied irrigation or fertilizer and generally those installed use surface sprinkler systems and fertilizer application by means similar to the soil turf and modified sand methods. The majority of installations have also used a modified surface zone by including a layer of organics. This effect minimizes the capillary action (a benefit of the membrane) since capillary rise will not readily transfer from the pure sand to the modified sand thus creating a barrier and necessitating supplementary surface applied irrigation and fertilizer. Those with perforated distribution pipes placed directly on the plastic membrane are impaired since the standard location of the perforation holes and the normally expected one inch ground settlement after construction causes some of the pipes to indent into the plastic blocking the holes and making them ineffective. Pumps used to assist in the removal of excess drainage water are ineffective when the water table is below the entry parts of the pipes due to loss of vacuum. Installations using special piping cross joints have shown irregular drainage capabilities due to restricted flow. Systems using only sand exhibit poor lateral liquid movement to or from a pipe system and require a larger head pressure for drainage. Under certain conditions, the head requirement results in a saturation curve within the sand that will intersect the surface between the pipes and cause surface puddling. Conversely, liquid attempting subsurface entry into the field is restricted in uniformity of distribution unless sufficient pressure is used which could then lead to a quick sand condition in the areas of the initial entry points. None of the systems exhibit positive and responsive control systems.

Although a search has not been made, U.S. Pat. No. 3,461,675 granted to Izatt on Aug. 19, 1969 is illustrative of the type of system described hereinabove and improved upon by the present invention.

PRESENT INVENTION

The important criteria of this improved membrane sand system is to provide and maintain a deep rooted grass surface which exhibits vigorous growth and which has a level surface throughout without obstructions and which does not suffer compaction problems. The system is capable of minimizing environmental problems created by variable climatic conditions of the various locales in which it is installed includes effective surface drainage abilities as well as nutrified liquid replacement to the plants growing zone on a uniform and continuous demand basis as the plant and climatic conditions dictate. Soil warming techniques for frost and snow melting create surface drainage and plant drying out effects and the system is capable of handling these factors.

The prime consideration of this improved membrane sand system is to control the water table within the isolated membrane area and the assurance of uniformity of lateral distribution of the nutrified liquid reservoir such that the surface zone moisture content is maintained. This control and distribution ensures the proper relationship of nutrified water and oxygen for the particular sand type and within the tolerance limits for the plant. Water and nutrients, whether applied by subsurface means or at the surface, move freely to the membrane reservoir by the excellent vertical drainage characteristics of the sand. This reservoir in turn feeds the grass plant by capillary action inherent with the sand. Excess water occuring during rainfall is discharged out of the system, conserving first any rain water that can be retained for irrigation purposes. Irrigation water make-up is preferably applied through the utilization of a subsurface pipe grid utilized for both the drainage and the irrigation or may be applied by conventional surface means. Fertilizer is added to the irrigation water using liquid fertilizers and an injection system or may be surface applied.

It has been well demonstrated that depending upon passage of time and as a characteristic of a selected sand, the sand absorbs the same amount of liquid whether or not it is applied at the surface or from beneath. It can also be easily demonstrated that the absorption of the sand is proportional to its depth and the moisture content at any level can be determined as a function of the depth of a particular gradation of sand.

The capillary rise in the sand, in addition to the drainage characteristics, is dependent upon the gradation and makeup of the sand and is controllable by proper selection of these materials and the establishment of a water table. The rate of capillary rise is particularly critical in extremely dry climates and the drainage rate is critical in areas of heavy rainfall. It is also required that the selection of the gravel be such that its gradation, in comparison with that of the particular sand, be compatible to ensure that the sand will penetrate the gravel layer by a depth of approximately one inch. This penetration places the bottom of the sand layer below the minimum water table to allow capillary action and yet the lateral flow characteristics of the gravel are not impaired.

It can thus be seen that maintaining a water table at the bottom of a natural sand layer permits the more accurate control of the moisture content at the growing level. Further the natural sand surface extends the playing season by its low moisture retention and thus its ability to hold back freezing for a slightly longer period and to thaw out more rapidly. The dormant period of the plant is thus reduced. The addition of a uniform heat source, combined with the proper seed selection, may further extend the season by encouraging early growth and resisting die back caused by cold. The inclusion of an insulation layer under the membrane will minimize frost penetration to the subgrade at times when the heating system is not in use.

In summary, an accurately controlled, frequently watered, properly fertilized well drained field provides for the best quality grass playing surface as well as encouraging rapid regrowth and thus providing maximum utilization. Healthy plants are less susceptible to disease and infestation and a natural grass surface provides much lower air temperatures immediately over the playing surface than the prevailing ambient conditions while providing the immediate air with an enrichment of oxygen. Only this improved membrane sand method with automatically operated subsurface drainage and fertilization in combination with irrigation, i.e. "fertigation," provides these requirements on a continuous demand basis as determined by the plant and the environment. The grass itself, in growing, has a deep rooted characteristic as it reaches down to the water table and thus has better wear and tear capabilities, since the plant is more firmly anchored and thus suffers only leaf damage during extensive use which is rapidly replaced by vigorous regrowth. The utilization of "fertigation" by subsurface application is a continuous, uniform and steady means which when coupled with the membrane isolated area, carefully selected growing medium and liquid transfer medium and system coupled with accurate and responsive control method provides these requirements.

It is an object of the present invention to provide a playing surface support material and method which maximizes the utility of a field and minimizes the maintenance requirements under the most variable and severe climatic conditions.

Still a further object of the present invention is to provide a system for establishing and maintaining a grass play surface comprising the steps of: (1) grading the subgrade at the site of the proposed surface, (2) placing a fluid impermeable membrane adjacent the graded surface with or without inclusion of an insulation layer, (3) providing a means of central supply and removal of fluid at the appropriate location in the graded surface, (4) providing a layer of horizontal flow gravel on top of the membrane, (5) placing a lateral liquid distribution system throughout the desired area on top of the gravel layer, (6) providing a layer of sand with appropriate permeability, capillary and porosity characteristics and having a substantially level upper surface without obstructions into which the grass will be planted, (7) provide a means exterior to the field to direct excess drainage water from the field to the site storm system, (8) providing a responsive control system to control the liquid level within the confines of the membrane beneath the grass, (9) provide an adequate fertilizer injection and water make-up system to sustain optimum growth and replace transpired and evaporated water, (10) provide a drain line to remove all liquid from the contained reservoir, (11) when required, installation of a soil warming system to melt snow and remove frost, (12) when required, to provide a means to sense the nutrified condition of the contained liquid.

Still another object of the present invention is to provide a membrane sand type grassed sports surface including automatic means to provide irrigation as needed, provide fertilizer on a predetermined schedule, and to withdraw liquid from the field in the event that the level within the membrane exceeds the maximum desirable for optimal utilization of the field while maintaining the quality and quantity of nutrified liquid to stimulate healthy growth.

It is another object of the present invention to provide a grass playing field which includes a growing medium having predictable capillary action overlying a liquid containing material having horizontal flow characteristics assuring uniformity of distribution under low infeed pressure requirements in which are placed conduits for the addition of water and fertilizer to the liquid reservoir.

A still further object of the present invention is to provide a grass supporting medium wherein the upper layer provided a firm noncompacing surface with predictable permeability permitting ready drainage and an underlying surface permitting lateral fluid movement such that a minimum head is required to effect the drainage.

Still another object of the present invention is to provide a means located within the field beneath the grass sports surface for determining the level of liquid within the grass supporting medium interconnected with a means exterior of the field to provide ready and convenient information as to the liquid level.

It is another object of the present invention to provide a means and mechanism to sense the system's water level and magnetically transmit this into low voltage electrical signals and relays these to a programmable control panel which, in turn, operates, using a low voltage power supply, the irrigation infeed and drainage outflow valves. The system utilizes available irrigation water pressure to function the main valves through small solenoid valves located on the bleed lines from the irrigation line. This method thereby minimizes any electrical hazard.

It is another object of the present invention to provide a means and mechanism when electrical energy is not available to use float operated devices activated by the systems water table and coupled to the irrigation bleed line valves to transmit the irrigation pressure into a force to open or close the irrigation and drainage valve.

A further object of the present invention is to provide a means and mechanism for extending the usable season for a playing field through the use of underground heaters and protective sub-grade insulation layer combined with a system which accommodates the generated drainage requirements while simultaneously providing a continuous source of liquid to avoid the drying effect normally associated with artificial heating devices.

Yet a further object of the present invention is to provide a grass field which may have a chemical inbalance corrected without resorting to a restructuring or replacement. A drain and irrigation system is provided such that all chemicals or the like may be easily washed by means of purging from the grass supporting medium effecting a neutral condition. It is also the object of the drain to allow removal of all liquid from the entire system when necessary.

BRIEF DESCRIPTION OF THE DRAWINGS

FIG. 2 is a sectional view taken along the lines 2—2 of FIG. 1.

FIG. 4 is an elevational view of the water supply header as seen along lines 4—4 of FIG. 3.

FIG. 5 is a plan view of a valve station.

FIG. 6 is an elevational view of a valve station.

FIG. 7 is an elevational view of the electrically sensed level control unit.

DETAILED DESCRIPTION OF THE DRAWINGS

Figure 1:
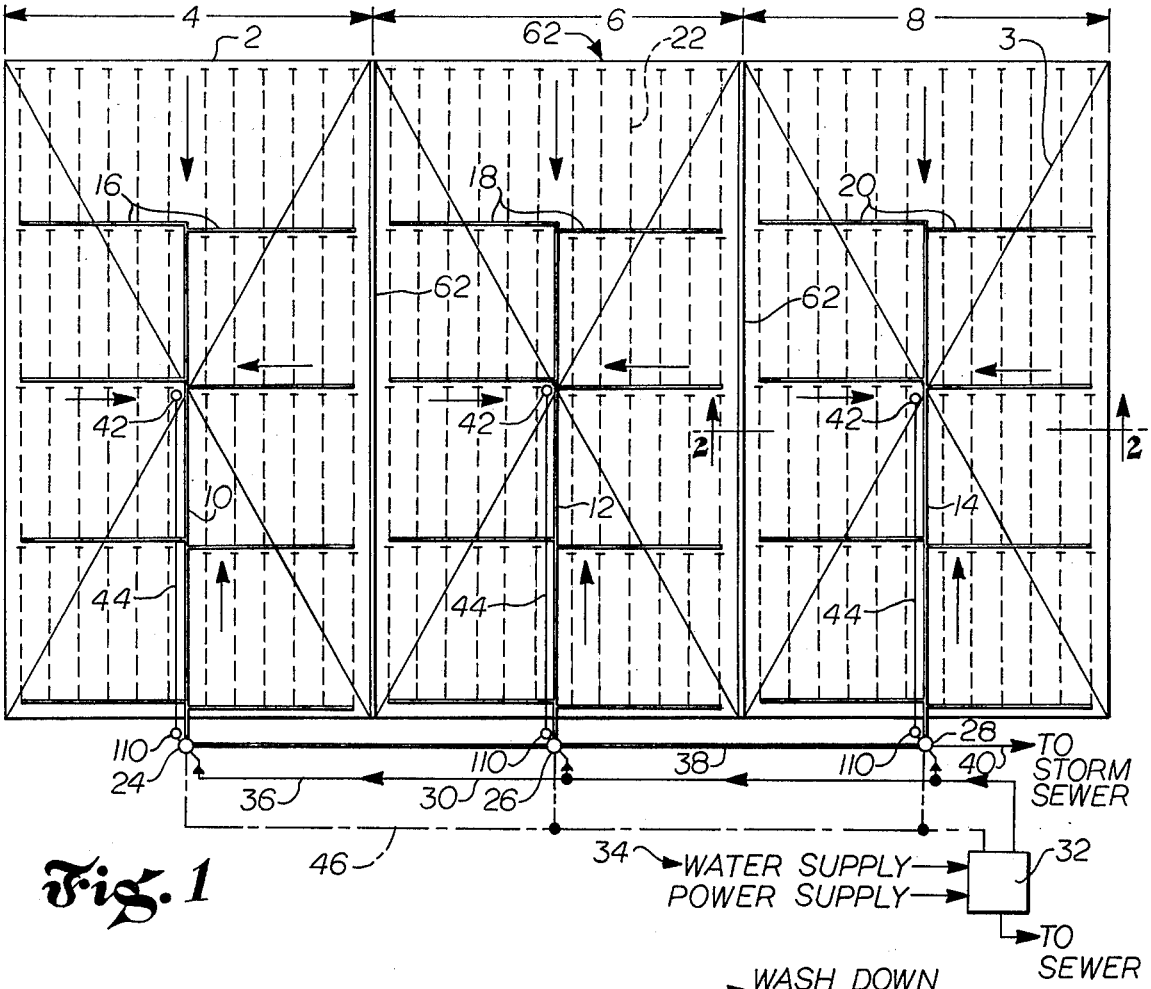
FIG. 1 is a plan view of a typical field layout utilizing the present invention.

As seen in FIG. 1, the field generally designated as 2 is divided into three essentially equal sections 4, 6 and 8 and defined internally by a division along lines 62. It is to be understood that the size and shape of the field as well as external conditions such as climatic factors and degree of use will determine the number and shape of the sections. Each section has a slope in the sub-grade designated in diagonal lines 3 to a low point at approximately the center of the section where the water level detector 42 will be located as explained hereinafter. Within each section of the field there will exist a field section main 10, 12 and 14 interconnecting with the required number of horizontal field distribution piping headers 16, 18 and 20. A plurality of perforated field distribution pipes 22 form a substantially equally spaced grid work throughout the field assuring reasonably equal distribution and/or saturation.

Each of the sloping field section mains 10, 12 and 14 are connected to a valve station 24, 26, 28 located below grade outside the playing area and are interconnected by means of an irrigation feed system 30 which is interconnected with and controlled from the control room 32 which in turn is connected to the water supply 34. These field distribution pipes 22 and the headers 16, 18 and 20 as well as the mains 10, 12 and 14 may also be used to discharge excess water by means of the drainage system 36, 38 and 40 which lead to an off site storm system. It is to be noted that the water level detector 42 and its interconnected tube 44 (one for each section) likewise is interconnected with the valve station and with a storm drain after passing through the water level sensing unit 110. Also seen in this view is the low voltage electrical control system designated generally as 46 from the control room to each one of the valve stations.

Referring now to FIG. 2 which, as noted above, is a vertical sectional view taken along lines 2—2 of FIG. 1, it can be seen that the field includes a subgrade 50 which slopes within each section towards its center and the water level detector 42 which can also act as a drainage means. At midpoint of each section is located the trench 52 to accommodate the piping exiting for each section and includes sand bedding 54 supporting the field section main 10. The water table level tube 44 is also placed within trench 52 which is terminated at the center of the section with a vertical perforated tube designated as the water level detector 42. The remainder of the trench is filled with onsite material 56 and a membrane 58 is placed over the sub-grade and sealed at the conduit entry points thus establishing an enclosed dish-like area for the irrigation and grass support purposes. As the trench exits the perimeter of the system a 5 foot long plug using impervious materials is inserted in the trench to ensure a positive seal to the trench itself.

As noted above, the entire field is broken into field sections. The field sections are defined by a perimeter berm 60, which extends around the entire periphery of the field, and upwardly extending section divisions 62 extending across the field and across which the membrane 58 is folded. The subgrade 50, as noted above, is sloped toward the center of each section but the gravel layer 64 which lies thereupon and supports a perforated field distribution piping 22 as well as the piping headers 20 has a horizontal or level upper surface. It is to be noted that this surface in general will define the minimum water level through the weir action of the perforations in the event of automatic control shutdown. The gravel layer with horizontal flow characteristics assures even distribution of water or fertilizer.

The perforations of the field distribution piping are placed downwards on top of the gravel and the pipes are then covered with a filter cloth wrapping 66. This cloth is standard to earth work projects and prevents the fines loss from the sand from entering the piping system. The pipe is not entirely wrapped but is covered with the filter cloth which is then tucked on each side of the pipe with the edges projecting outward by three or so inches. This method of wrapping is essential since wrapping the pipe on its entire circumference could lead to clogging through salted out fertilizer particles being trapped in the filter material 66. The method employed allows the holes to remain uncovered while the sand is prevented from entering the pipe without first passing through the gravel 64. This is not possible because of the particular selection of the gravel gradation. The sand layer 68 is then placed, overlying the gravel and the distribution piping. The grass 70 is planted at the top of the sand layer at the field elevation which is level throughout. The root structure will generally extend vertically downwardly to reach the established water table and not bunching toward the pipes.

Figure 3:
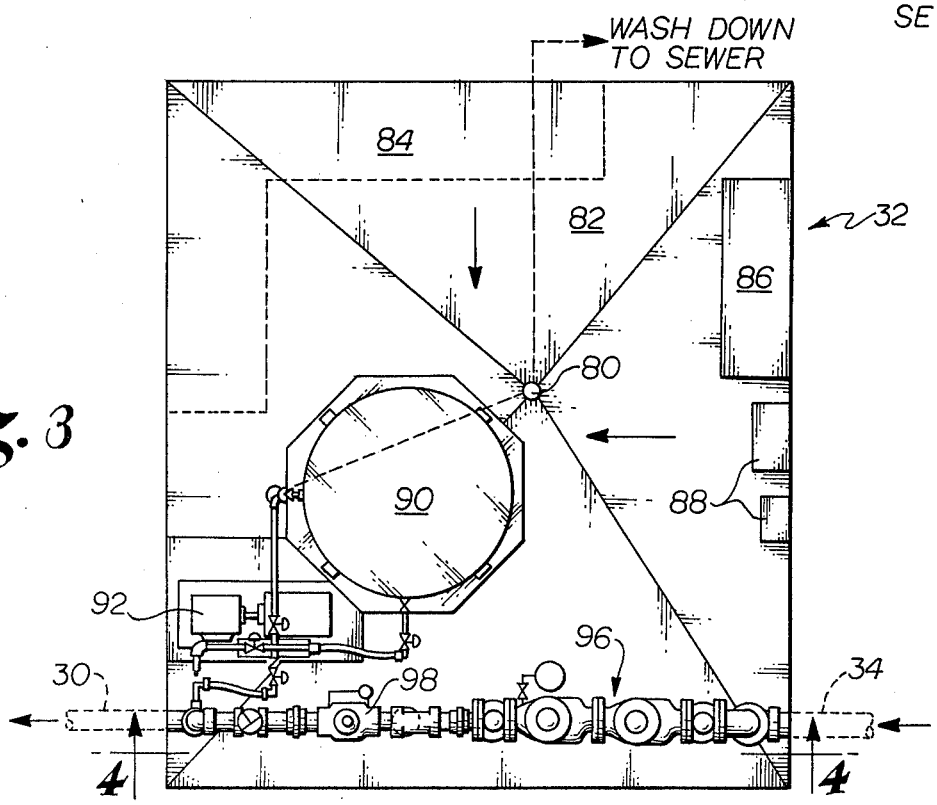
FIG. 3 is a plan view of the preferred control room.

As seen in FIG. 3, the preferred embodiment of the control room is shown. For ease of cleaning, the control room includes a floor drain 80 at the intersection of the various portions of the sloping floor 82. Mounted about the perimeter of the room is fertilizer storage 84 and control panel 86, the required breaker panel and disconnect devices 88. Mounted upon the floor of the control room is the fertilizer holding tank 90 which has mounted adjacent thereto the fertilizer injection pump 92 for selectively injecting the fertilizer into the irrigation feed 30 as explained in greater detail with respect to FIG. 4.

Referring now to FIG. 4, which is a sectional view taken along lines 4—4 of FIG. 3, it is seen that the water supply 34 is located beneath grade, is elevated into the water supply header which includes a wash down hose connection 94, back flow preventer set 96, a strainer and clean out 106, a pressure regulator 98, a test pressure gauge connection 108, a fertilizer injection valve 100 and a pump purge feed connection 102, in addition to manual isolating shutoff valves 104.

In FIG. 5, a plan view of a valve station, there can be seen that the water level tube 44 extends into the water level sensing unit 110, as described in greater detail hereinafter, and is connected by means of a conduit to the automatic field drain valve 112 which can, as the name implies, be used to remove all liquid from the field as may be required for purging. Just before the automatic field drain valve 112 is a vertical water level sight tube 111 complete with a colored float and transparent casing to allow for visual inspection of the water table level within the field section. Also extending into the valve station is the field section main 10 which at its termination has located an automatic drainage valve 128 which, when open, allows excess water to discharge to the site storm system. The liquid make-up supply to the field section main 10 is through the irrigation feed 36 which includes an irrigation feed line drain 116. Also to be noted in view is a bleed line 118 for pressure assisting the automatic valves.

Looking now at FIG. 6, which is a sectional view taken along lines 6—6 of FIG. 5, it can be seen that the valve station lies below the field elevation and as noted in FIG. 1, is outside the playing boundaries and further, outside the boundaries of the controlled field. The valve station includes a closing cap 120 and is surrounded by means of a rigid side 122 and a floor 124. As seen in this view, the water level tube 44 extends outwardly generally toward the field and within the manhole chamber it terminates with the automatic drain valve 112 which is immediately preceded by the water level sight tube 111. The field section main 10 as seen in this view, lies immediately in front of the water level tube 44 and terminates with the automatic discharge valve 128. Further to be seen in this view, is the irrigation supply to the section mains 10 following the irrigation feed line drain 116, shown in FIG. 5, is a strainer and clean out 119, bleed line shut-off 118, automatic irrigation supply valve 126, a balancing valve 127 and a test pressure gage connection 129. The discharge to the storm system is designated 36.

The water level sensing unit for use in the totally automatic system is seen in FIG. 7 and as seen, this also lies beneath the field elevation and is covered by a removable cap 130 which covers a vertically placed PCV pipe 132. A plurality of reed switches 134 are mounted and sealed in a vertical member 135. A buoyant toroidal shaped float 136 having permanent magnets 137 imbedded therein closes the reed switches 134 by magnetic flux which opens and closes the LV=low voltage electrical switches in the terminal base 138 which relays a signal to the main control panel which in turn actuates valves to add or remove liquid from the field. The liquid level within the water level sensing unit is directly responsive to the level within the field. This unit in conjunction with the water level detector 42 and the interconnecting conduit 44 form a U-tube. Tube 44, lying at the lowest portion of the section may be used as a drain for purging the field by opening the automatic field drain valve 112 shown in FIG. 5 and located within the valve station. Further to be seen in this view, is the connection with the low voltage electrical control system 46 and the conductivity sensor 139 for relaying the condition of the nutrified liquid.

Figure 8:
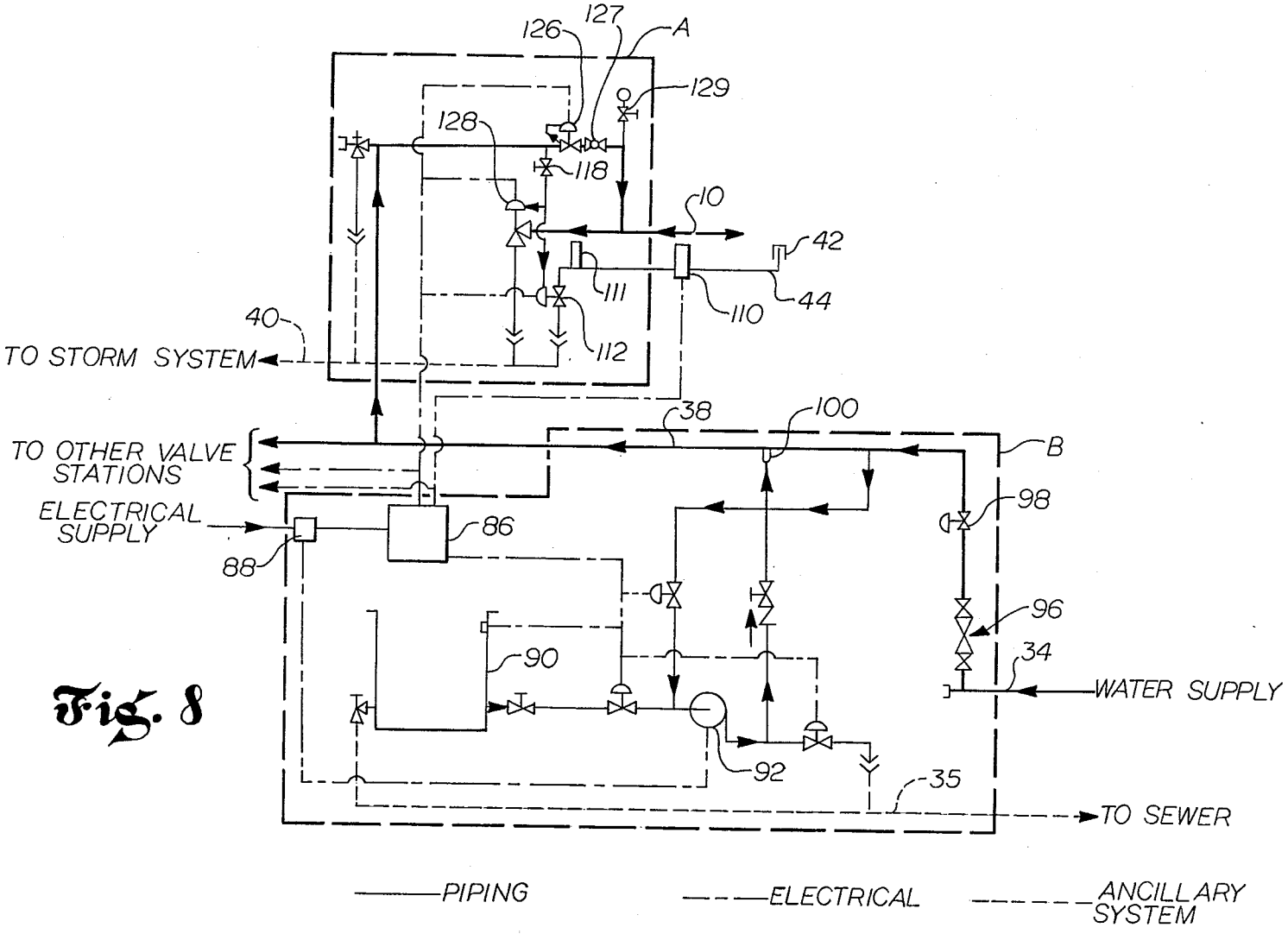
FIG. 8 is a flow diagram for an automated system.

As seen in FIG. 8, the flow diagram is generally divided into two sections (A) which is generally within the valve station and (B) which is generally within the control room. As seen in this view, the water enters the control rooms by means of conduit 34, passes through the back flow preventer 36, pressure regulator 98, and then for purging of the pump, an auxiliary line is fed to the fertilizer injection pump 92 with the main line proceeding after the injection valve 100 directly to the valve station via conduit 38. Fertilizer from the holding tank 90 is automatically directed to the fertilizer pump 92 and then through line 38 to the valve stations. Also seen in this view, is a means to purge the pump to the sewer or to dump the storage tank. Within a typical valve station the water passes through the irrigation supply valve 126, the balance valve 127, and then to the field section main 10. The feedback demonstrating a need for water is generated by the water level tube 44 and the water level sensing unit 110. Further to be seen in this view, the electrical supply passes through the power panel 88, the master irrigation control 86, and is fed to the various valving, pumps and water level sensing units necessary to perform the functions as described hereinabove. It is to be remembered that all power except for the pump is low voltage.

Figure 9:
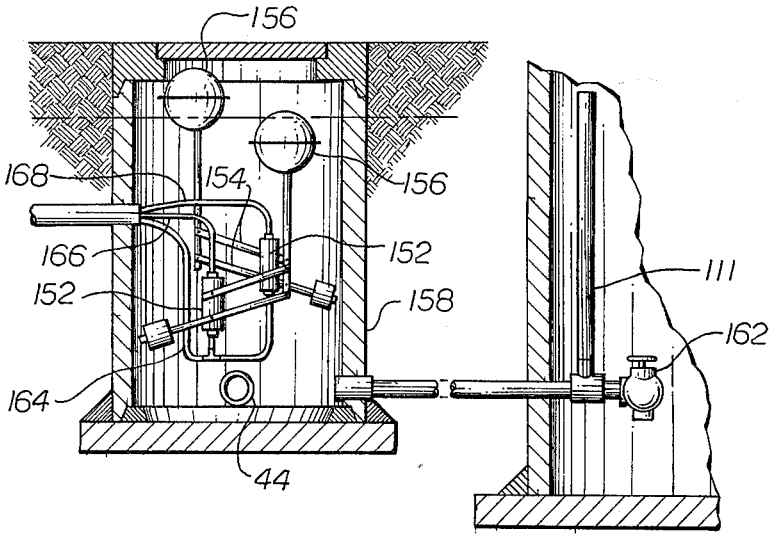
FIG. 9 is an elevational view of an alternate mechanically sensed level control unit.

A preferred control for a system when electrical power is not available is shown in FIG. 9. This installation provides for a mechanically automated system employing a completely controlled method for subsurface drainage and irrigation. With this system, control room is not required and is replaced with a water supply header and an automatic fertilizer application is not contemplated and thus is not included. The control utilizes mechanically functioning float activators 152 linked by parallel linkage 154 to floats 156 all mounted within a manhole 158. A water level tube 44 continues through the control manhole and terminates as for the automatic system, in the valve station with a water level sight tube 111 and manual drain valve 162. The float activators utilize the water pressure from the irrigation line through bleed lines 164, 166 and 168 to open and close the pressure operated irrigation and drainage discharge valves.

Figure 10:
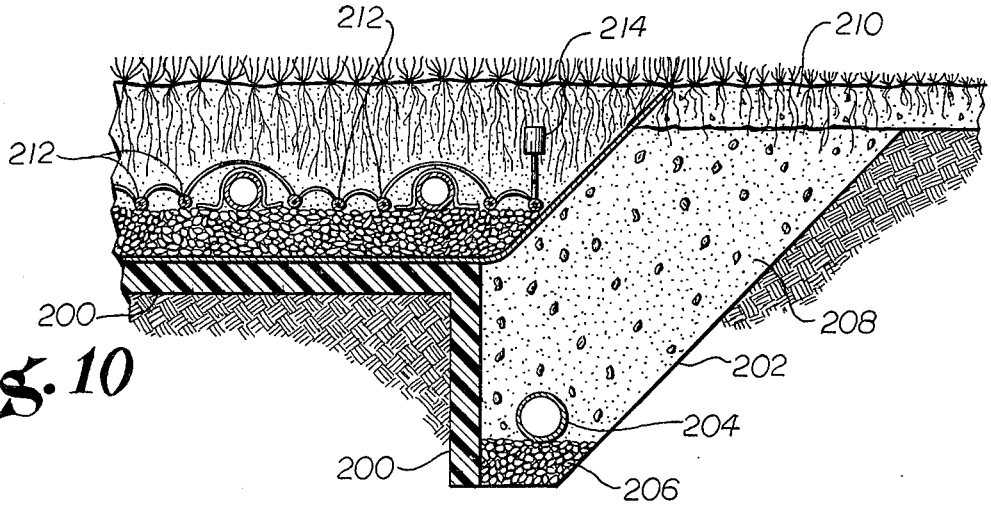
FIG. 10 is a sectional view of an alternate construction when heating and sub-grade insulation is included.

FIG. 10 illustrates, for full disclosure, and alternate embodiment of the extreme right end portion of FIG. 2. Heating cables and a sub-grade insulation barrier included as well as a modified periphery of the field. As can be seen, the insulation layer 200 is placed directly under the membrane over the entire field area. At the perimeter this insulation is carried vertically downwards to a location at least 6 inches below the contemplated frost penetration for the locale. The exterior perimeter is trenched 202 to accommodate the insulation and a standard type perimeter drainage system 204. The drainage pipe 204 is bedded on sand 206 and the entire excavation is backfilled to within 6 inches of the surface with free draining select granular fill 208 to ensure elimination of frost heave problems. The surface of the backfilled trench is graded with 6 inches of top soil 210 to support grassing. Referring to the detail within the membrane isolated area, it can be seen that the heating cable system 212 is located over the gravel layer and under the sand layer. The controls for the soil warming system include ground temperature sensor 214 and relay signals back to the main panel in the central room to ensure gradual heat elevation and reduction controls using solid state devices such that the grass root system is not subjected to thermal shock. The heating system when combined with the sub-grade insulation may be used intermittently or continuously throughout the winter as user requirements and economics demand.

Although the completely automatic system has been described in detail, it is to be understood that many of the operations may be handled manually in any one of several combinations. In extremely cold climates, the installation may be enhanced through the use of an insulated membrane or heaters, if necessary as pointed out above. If necessary, the insulation may be used to isolate and keep dry a portion of the subsoil to prevent frost heaving and the subsequent misalignment of the critical elements.

Thus as can be seen, the present system provides a unique method for establishing and maintaining grass play fields with superior long term results and lower overall maintenance and upkeep.

What is claimed is:

1. A system for growing and sustaining a grass playing field, comprising:

a graded subsoil base;

liquid impervious means supported by said subsoil base to form a subsurface liquid reservoir;

an upper layer of primarily sand-containing particulate material in which grass may be anchored and supported for growth and in which liquid characteristically moves primarily in the vertical direction; and a lower layer of particulate material located substantially adjacent said upper layer, between said upper layer and said liquid impervious means, said lower layer consisting essentially of gravel in which liquid characteristically moves well in the horizontal direction, as well as downwardly, such that liquid in said lower layer tends to be distributed substantially uniformly in the horizontal direction, wherein the physical characteristics of the essentially gravel particulate material of said lower layer and the primarily sand-containing particulate material of said upper layer are such that the sand-containing particulate material does not significantly penetrate into the gravel, so that, consequently, the void ratio of the gravel remains substantially unimpaired.

2. The system of claim 1, wherein said upper and lower layers are each substantially homogeneous from top to bottom, and wherein liquid moves directly between said upper and lower layers, there being no intermediate barrier layer between said upper and lower layers.

3. The system of claim 1, wherein said upper layer consists essentially of sand and contains substantially no inorganic material.

4. The system of claim 1, wherein the majority of the sand particles in said upper layer range in size from 0.25 to 0.6 millimeters in diameter, and wherein the gravel in said lower layer is no larger than ⅜ths inch in diameter.

5. The system of claim 1, including means for monitoring the level of liquid in the subsurface liquid reservoir.

6. The system of claim 5, wherein the monitoring means comprises a generally U-shaped tube-like element, said tube-like element being in liquid communication with the liquid in the liquid reservoir so that the liquid level in the one leg of said tube-like element is representative of the level of the liquid in the liquid reservoir, the other leg of the tube-like element being located outside of the boundary of the playing field, the liquid in the other leg having a measurable characteristic which is representative of the level of the liquid in the liquid reservoir, said monitoring means further including means for measuring said characteristic.

7. The system of claim 1, including means for adding and removing liquid from the liquid reservoir.

8. The system of claim 1, including means for adding nutrients to the liquid in the liquid reservoir.

9. The system of claim 6, including means for monitoring the nutrients in the liquid in said tube-like element.

10. The system of claim 1, wherein the top surface of said lower layer is substantially horizontal, and wherein said means for adding and removing liquid includes conduit means positioned on the top surface of said lower layer.

11. The system of claim 10, wherein the playing field is divided into a plurality of sections, and wherein said conduit means includes a header pipe which extends over a substantial portion of the length of each section, and a plurality of branch pipes which extend perpendicularly away from said header pipe, substantially to the longitudinal edges of said sections, said conduit means further including a main field pipe which extends out of the area of the playing field and connecting pipes which connect said header pipes to the main field pipe.

12. The system of claim 11, wherein said branch pipes have openings therein, and wherein said conduit means includes a filter cloth wrapping which extends around the upper portion of the branch pipes and then outwardly over a small adjacent portion of the top surface of said lower layer.

13. The system of claim 1, including means for heating the playing field.

14. As method for growing and sustaining a grass playing field, comprising the steps of:

planting grass in an upper particulate layer of the field, in which upper layer liquid characteristically moves primarily in the vertical direction, the roots of the grass being anchored and supported for growth in the upper layer;

establishing a reservoir for liquid substantially directly beneath the upper layer, so that liquid may move directly upward from the liquid reservoir through the upper layer to the roots of the grass and downwardly from the top surface of the upper layer through the upper layer to the liquid reservoir; and distributing liquid, which has moved into the lower surface area of the upper layer upwardly from the liquid reservoir or downwardly from the top surface of the upper layer, substantially uniformly over the lower surface area of the upper layer, so that liquid moving upwardly from the liquid reservoir through said upper layer provides substantially uniform nourishment for the grass over the area of the playing field, and so that liquid may move rapidly downwardly through the upper layer into the liquid reservoir, thereby maintaining the top surface of the upper layer substantially free of standing liquid.

15. The method of claim 14, wherein the upper layer is substantially homogeneous from top to bottom and wherein the reservoir of liquid is established and maintained in a lower layer consisting essentially of gravel, the upper layer being substantially adjacent the lower layer.

16. The method of claim 14, including the step of monitoring the level of liquid in the liquid reservoir.

17. The method of claim 14, including the step of adding liquid to and removing liquid from the liquid reservoir to maintain the liquid in the liquid reservoir at a selected level.

18. The method of claim 14, including the step of adding nutrients to the liquid in the liquid reservoir as needed.

19. A system for draining liquid from a large area, such as a playing field, to a drainage system external of the large area, comprising:

an upper layer of primarily sand-containing particulate material in which liquid characteristically moves primarily in the vertical direction;

a lower layer of particulate material located substantially adjacent said upper layer, said lower layer consisting essentially of gravel in which liquid characteristically moves well in the horizontal direction, as well as downwardly, so that liquid applied to the top surface of said upper layer tends to move rapidly downwardly into said lower layer, where it tends to disperse rapidly horizontally, wherein the physical characteristics of the essentially gravel particulate material of said lower layer and the primarily sand-containing particulate material of said upper layer are such that the sand containing particulate material does not significantly penetrate into the gravel, so that consequently, the void radio of the gravel remains substantially unimpaired; and means communicating said lower layer with the external drainage system, so that liquid dispersing horizontally in said lower layer may move into the external drainage system and be carried away.

20. The system of claim 19, wherein said upper and lower layers are each substantially homogeneous from top to bottom, and wherein liquid moves directly between said upper and lower layers, there being no intermediate barrier layer between said upper and lower layers.

21. The system of claim 19 wherein said upper layer consists essentially of sand.

22. The system of claim 19, including conduit means for removing liquid from said lower layer into the external drainage system.

23. The system of claim 22, wherein the large area is divided into a plurality of sections, and wherein the top surface of said lower layer is substantially horizontal, said conduit means being positioned on the top surface of said lower layer and including a header pipe which extends over a substantial portion of the length of each section, and a plurality of branch pipes which extend perpendicularly away from said header pipe, substantially to the longitudinal edges of said sections, said conduit means further including pipes connecting said header pipes to the external drainage system.

24. An apparatus for monitoring the level of liquid in a grass playing field which includes a subsurface liquid reservoir, the apparatus comprising:

a generally U-shaped tube-like element, said tube-like element being in liquid communication with the liquid in the liquid reservoir, one leg of said tube-like element being positioned within the playing field such that the level of the liquid in the one leg is representative of the level of liquid in the playing field, the other leg being positioned outside of the boundary of the playing field, the liquid in the other leg having a measurable characteristic which is representative of the level of liquid in the playing field; and means for measuring said characteristic.

25. An apparatus of claim 24, wherein the characteristic is liquid pressure.

26. An apparatus of claim 24, wherein the characteristic is liquid level.

27. An apparatus of claim 24, wherein said determining means includes means responsive to said characteristic for providing electrical signals indicative of said level of liquid in the playing field.

28. An apparatus of claim 27, including means responsive to said electrical signals for adding and deleting liquid to and from the liquid reservoir so as to maintain the liquid in the playing field at a selected level.

* * * * *